US007776789B2

(12) United States Patent
Araki et al.

(10) Patent No.: US 7,776,789 B2
(45) Date of Patent: Aug. 17, 2010

(54) THERMAL TRANSFER SHEET

(75) Inventors: Tomoko Araki, Tokorozawa (JP); Munenori Ieshige, Okayama (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 762 days.

(21) Appl. No.: 11/659,163

(22) PCT Filed: Jul. 28, 2005

(86) PCT No.: PCT/JP2005/013865

§ 371 (c)(1),
(2), (4) Date: Feb. 1, 2007

(87) PCT Pub. No.: WO2006/013782

PCT Pub. Date: Feb. 9, 2006

(65) Prior Publication Data

US 2009/0022913 A1 Jan. 22, 2009

(30) Foreign Application Priority Data

Aug. 2, 2004 (JP) ..... 2004-225971

(51) Int. Cl.
*B41M 5/035* (2006.01)
*B41M 5/50* (2006.01)

(52) U.S. Cl. ..... 503/227; 8/471

(58) Field of Classification Search ..... None
See application file for complete search history.

(56) References Cited

FOREIGN PATENT DOCUMENTS

| | | | |
|---|---|---|---|
| JP | 03-007385 | | 1/1991 |
| JP | 04-022685 | | 1/1992 |
| JP | 05-016540 | | 1/1993 |
| JP | 05-016540 | A | 1/1993 |
| JP | 06-048053 | | 2/1994 |
| JP | 07-237361 | | 9/1995 |
| JP | 07-237361 | A | 9/1995 |
| JP | 08-156432 | | 6/1996 |
| JP | 08-156432 | A | 6/1996 |
| JP | 08-295083 | | 11/1996 |
| JP | 10-272847 | | 10/1998 |
| JP | 10-272847 | A | 10/1998 |
| JP | 2002-187371 | | 7/2002 |
| JP | 2002-187371 | A | 7/2002 |

OTHER PUBLICATIONS

Supplementary European Search Report and European Search Opinion.

*Primary Examiner*—Bruce H Hess
(74) *Attorney, Agent, or Firm*—Harness, Dickey & Pierce, PLC

(57) ABSTRACT

The present invention is directed to the provision of a thermal transfer sheet that can realize a high maximum transfer density in printing, does not cause blocking during storage in a roll form, can suppress, in a roll form, the transfer of a dye onto a backside layer, which faces the dye layer, does not cause an abnormal transfer in which, in printing on an object, the dye is transferred together with a dye layer onto the object, can further reduce the density in a highlight part in printing, and can form printed matter which is excellent in reproduction of gradation from highlight to shadow without any trouble. The thermal transfer sheet comprises a base material, a heat resistant slip layer provided on one side of the base material, and a dye layer provided on the other side of the base material, wherein the dye layer comprises a binder resin having a loss modulus at 60° C. of not less than $10^7$ Pa, a loss modulus at 100° C. of not less than $10^6$ Pa and a loss modulus at 150° C. in the range of $10^4$ Pa to $10^5$ Pa.

5 Claims, 1 Drawing Sheet

THERMAL TRANSFER SHEET

TECHNICAL FIELD

The present invention relates to a thermal transfer sheet comprising a base material, a heat-resistant slip layer provided on one side of the base material, and a dye layer provided on the other side of the base material. More particularly, the present invention relates to a thermal transfer sheet that can realize a high maximum transfer density in printing, does not cause blocking during storage in a roll form, can suppress, in a roll form, the transfer of a dye onto a backside layer, which faces the dye layer, does not cause an abnormal transfer in which, in printing on an object, the dye is transferred together with a dye layer onto the object, can further reduce the density in a highlight part (low density part) in printing, and can form printed matter which is excellent in reproduction of gradation from highlight (low density) to shadow (high density) without any trouble.

BACKGROUND ART

Various thermal transfer recording methods are known in the art. Among others, a method for forming various full-color images has been proposed. In this method, a thermal transfer sheet comprising dye layers formed by holding, by a suitable binder, dyes as recording materials for dye sublimation transfer on a substrate such as a polyester film is provided, and the sublimable dyes are thermally transferred from the thermal transfer sheet onto a thermal transfer image-receiving sheet comprising a dye receptive layer provided on an object dyeable with a sublimable dye, for example, paper or plastic film to form a full-color image. In this case, a large number of color dots of three or four colors with the quantity of heat being regulated are transferred by heating by means of a thermal head as heating means in a printer onto a receptive layer in the thermal transfer image-receiving sheet to reproduce a full color of an original by the multicolor dots. In this method, since coloring materials used are dyes, the formed images are very sharp and are highly transparent and thus are excellent in reproduction of intermediate colors and in gradation and are comparable with images formed by conventional offset printing or gravure printing. At the same time, this method can form high-quality images comparable with full-color images formed by photography.

In the thermal transfer recording method utilizing the thermal dye sublimation transfer, an increase in printing speed of thermal transfer printers has posed a problem that conventional thermal transfer sheets cannot provide satisfactory print density. Further, higher density and higher sharpness have become required of prints of images formed by thermal transfer. To meet this demand, various attempts have been made to improve thermal transfer sheets and thermal transfer image-receiving sheets which receive sublimable dyes transferred from the thermal transfer sheets to form images. For example, an attempt to improve the sensitivity in transfer at the time of printing has been made by reducing the thickness of the thermal transfer sheet. This, however, poses a new problem that cockling occurs due to heat, pressure or the like applied at the time of the production of the thermal transfer sheet or at the time of thermal transfer recording and, in some cases, breaking of the thermal transfer sheet occurs.

Further, as described in patent document 1, an attempt to improve the print density and the sensitivity in transfer at the time of printing has been made by increasing the dye/resin binder ratio in the dye layer of the thermal transfer sheet. In this case, however, during storage in a wound state, the dye is transferred onto the heat resistant slip layer provided on the backside of the thermal transfer sheet, and, at the time of rewinding, the dyes transferred onto the heat resistant slip layer are retransferred onto dye layers of other colors or the like (a kick back phenomenon). When the contaminated layers are thermally transferred onto an image receiving sheet, hue different from a designated one is provided, or otherwise the so-called "smudge" occurs. To overcome the above problem, a proposal on a thermal transfer printer rather than the thermal transfer sheet side has been made. In this proposal, in thermal transfer at the time of image formation, high energy is applied in a thermal transfer printer. In this case, however, fusing of the dye layer to the receptive layer, that is, the so-called "abnormal transfer," is likely to occur. When a large amount of a release agent is added to the receptive layer for abnormal transfer prevention purposes, blurring, smudge and other unfavorable phenomena of the image occur.

Further, a proposal has also been made in which the maximum transfer density is enhanced by selecting a resin binder having a relatively low glass transition temperature for a dye layer in a thermal transfer sheet. In this case, however, the binder is disadvantageous in that the release of the dye occurs even upon exposure to a relatively low level of energy and, as a result, the transfer density is higher than the set value also in the highlight part in printing, resulting in a deterioration in reproduction of thermally transferred images. Patent document 2 describes that a binder resin containing not less than 90% by weight of a polyvinyl butyral resin, in which the molecular weight range and the glass transition temperature range have been specified and, further, the content of the vinyl alcohol part has been specified, is used as a component of the dye layer. Even when this thermal transfer sheet is used, however, the maximum transfer density is not on a satisfactory level.

Patent document 1: Japanese Patent Laid-Open No. 295083/1996

Patent document 2: Japanese Patent Publication No. 29504/1995

DISCLOSURE OF THE INVENTION

Problems to be Solved by the Invention

In view of the above problems of the prior art, the present invention has been made, and an object of the present invention is to provide a thermal transfer sheet that can realize a high maximum transfer density in printing, does not cause blocking during storage in a roll form, can suppress, in a roll form, the transfer of a dye onto a backside layer, which faces the dye layer, does not cause an abnormal transfer in which, in printing on an object, the dye is transferred together with a dye layer onto the object, can further reduce the density in a highlight part in printing, and can form printed matter which is excellent in reproduction of gradation from highlight to shadow without any trouble.

Means for Solving the Problems

The above object of the present invention can be attained by a thermal transfer sheet comprising a base material, a heat resistant slip layer provided on one side of the base material, and a dye layer provided on the other side of the base material, characterized in that said dye layer comprises a binder resin having a loss modulus at 60° C. of not less than $10^7$ Pa, a loss modulus at 100° C. of not less than $10^6$ Pa and a loss modulus at 150° C. in the range of $10^4$ Pa to $10^5$ Pa.

In a preferred embodiment of the present invention, the glass transition temperature of the binder resin is 60° C. or above.

EFFECT OF THE INVENTION

According to the present invention, in a thermal transfer sheet comprising a base material, a heat resistant slip layer provided on one side of the base material, and a dye layer provided on the other side of the base material, the use, as a binder resin for constituting the dye layer, of a resin satisfying the requirement of a loss modulus, that is, a loss modulus at 60° C. of not less than $10^7$ Pa, a loss modulus at 100° C. of not less than $10^6$ Pa and a loss modulus at 150° C. in the range of $10^4$ Pa to $10^5$ Pa can advantageously provide a thermal transfer sheet that, in the thermal transfer, has an improved sensitivity in transfer, can realize a high maximum transfer density in printing without the application of high energy, does not cause blocking during storage in a roll form, can suppress, in a roll form, the transfer of a dye onto a backside layer, which faces the dye layer, does not cause an abnormal transfer in which, in printing on an object, the dye is transferred together with a dye layer onto the object, can prevent an increase in the density in a highlight part in printing, and can form printed matter which is excellent in reproduction of gradation from highlight to shadow without any trouble.

DESCRIPTION OF REFERENCE CHARACTERS

1: base material,
2: dye layer,
3: heat resistant slip layer, and
4: primer layer.

BEST MODE FOR CARRYING OUT THE INVENTION

Figure 1:
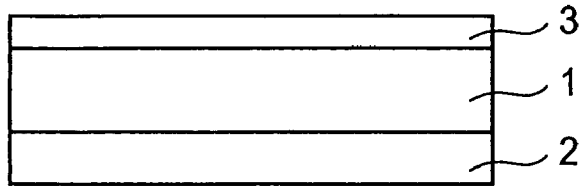
FIG. 1 is a schematic cross-sectional view showing one best mode of the thermal transfer sheet according to the present invention.
Figure 2:
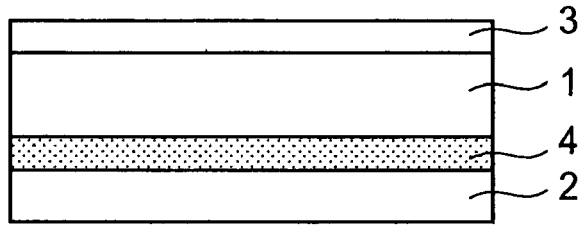
FIG. 2 is a schematic cross-sectional view showing another best mode of the thermal transfer sheet according to the present invention.

FIG. 1 shows one best mode of the thermal transfer sheet according to the present invention. A heat resistant slip layer (backside layer) 3 is provided on one side of a base material 1 to improve the slipperiness of a thermal head and, at the same time, to prevent sticking. A dye layer 2 is provided on the other side of the base material 1. FIG. 2 shows another best mode of the thermal transfer sheet according to the present invention. In this thermal transfer sheet, a heat resistant slip layer 3 is provided on one side of a base material 1, and a primer layer 4 and a dye layer 2 are provided in that order on the other side of the base material 1.

Each layer constituting the thermal transfer sheet according to the present invention will be described in detail.

(Base Material)

The base material 1 used in the thermal transfer sheet according to the present invention may be any conventional base material so far as the base material has certain level of heat resistance and strength. Examples of base materials usable herein include about 0.5 to 50 μm-thick, preferably about 1 to 10 μm-thick, films of polyethylene terephthalate, 1,4-polycyclohexylene dimethylene terephthalate, polyethylene naphthalate, polyphenylene sulfide, polystyrene, polypropylene, polysulfone, aramid, polycarbonate, polyvinyl alcohol, cellulose derivatives such as cellophane and cellulose acetate, polyethylene, polyvinyl chloride, nylon, polyimide, and ionomer.

The above base material on its dye layer forming side is often subjected to adhesion treatment. When a dye layer is formed by coating onto the surface of a plastic film as the base material, for example, the wettability of the plastic film by the coating liquid and the adhesion of the plastic film to the coating are often unsatisfactory. To overcome this drawback, adhesion treatment is carried out. Conventional resin surface modification techniques such as corona discharge treatment, flame treatment, ozone treatment, ultraviolet treatment, radiation treatment, roughening treatment, chemical treatment, plasma treatment, low-temperature plasma treatment, primer treatment, and grafting treatment as such may be applied to the adhesion treatment. These treatment methods may also be used in a combination of two or more. The primer treatment may be carried out, for example, by coating a primer liquid onto an unstretched film in the formation of a plastic film by melt extrusion and then stretching the film.

Further, the formation of a primer layer 4 by coating between the base material and the dye layer may also be carried out as the adhesion treatment of the base material. The primer layer may be formed of a resin. Resins usable for primer layer formation include: polyester resins; polyacrylic ester resins; polyvinyl acetate resins; polyurethane resins; styrene acrylate resins; polyacrylamide resins; polyamide resins; polyether resins; polystyrene resins; polyethylene resins; polypropylene resins; vinyl resins such as polyvinyl chloride resins, polyvinyl alcohol resins and polyvinylpyrrolidone; and polyvinyl acetal resins such as polyvinyl acetoacetal resins and polyvinyl butyral resins.

The primer layer may be formed by dissolving or dispersing the above resin optionally mixed with additives in water or an aqueous solvent such as alcohols or an organic solvent to prepare a coating liquid and coating the coating liquid by conventional coating means such as gravure printing, screen printing, or reverse roll coating using a gravure plate. The coverage of the primer layer is about 0.01 to 0.3 g/$m^2$ on a dry basis.

(Dye Layer)

The thermal transfer sheet according to the present invention comprises a base material, a heat-resistant slip layer provided on one side of the base material, and a dye layer 2 provided on the other side of the base material. The dye layer may be formed of a single layer of one color. Alternatively, a plurality of dye layers different from each other in hue of the dye contained therein are repeatedly provided in a face serial manner on the same plane in an identical substrate. The dye layer is a layer formed of a thermally transferable dye held by any binder. Dyes usable herein are dyes which, upon heating, are melted, diffused, or sublimation transferred. Any dye used in the conventional thermal transfer sheet for thermal dye sublimation transfer can be used in the present invention. The dye used, however, is selected by taking into consideration, for example, hue, sensitivity in printing, lightfastness, storage stability, and solubility in the binder.

Examples of dyes include: diarylmethane dyes; triarylmethane dyes; thiazole dyes; methine dyes such as merocyanine and pyrazolonemethine dyes; azomethine dyes typified by indoaniline, acetophenoneazomethine, pyrazoloazomethine, imidazoleazomethine, imidazoazomethine, and pyridoneazomethine dyes; xanthene dyes; oxazine dyes; cyanomethylene dyes typified by dicyanostyrene and tricyanostyrene dyes; thiazine dyes; azine dyes; acridine dyes; azo dyes such as benzeneazo, pyridoneazo, thiopheneazo, isothiazoleazo, pyrroleazo, pyrraleazo, imidazoleazo, thiadiazoleazo, triazoleazo, and disazo dyes; spiropyran dyes; indolinospiropyran dyes; fluoran dyes; rhodaminelactam dyes; naphthoquinone dyes; anthraquinone dyes; and quinophthalone dyes.

In the present invention, the binder resin in the dye layer is characterized by having specified loss moduli at 60° C., 100° C. and 150° C. Specifically, the loss modulus of the binder resin is not less than $10^7$ Pa at 60° C., not less than $10^6$ Pa at 100° C., and not less than $10^4$ Pa and not more than $10^5$ Pa at 150° C. In the present invention, the loss modulus may be measured by providing ARES manufactured by Rheometrix Corp. as a measuring device and raising the temperature of the binder resin from 30° C. to 200° C. under conditions of parallel plate 25 mmϕ, strain 0.1%, amplitude 1 Hz, and temperature rise rate 2° C./min to read the loss moduli at 60° C., 100° C. and 150° C.

The loss modulus is a viscous element of the measured material, that is, represents the toughness of a film of the binder resin and is considered to be equivalent to static shear stress. In the present invention, the loss modulus of the binder resin in the dye layer at 60° C. is not less than $10^7$ Pa. Preferably, the lower limit of the loss modulus at 60° C. is $1\times10^7$ Pa. The upper limit of the loss modulus at 60° C. is about $10^8$ Pa, preferably about $1\times10^8$ Pa. Regarding the loss modulus of the binder resin in the dye layer at 100° C., the lower limit is $1\times10^6$ Pa, and the upper limit is about $10^8$ Pa, preferably about $1\times10^8$ Pa. Likewise, regarding the loss modulus of the binder resin in the dye layer at 150° C., the lower limit is $10^4$ Pa, preferably $1\times10^4$ Pa, and the upper limit is $10^5$ Pa, preferably $1\times10^5$ Pa.

When the loss modulus of the binder resin in the dye layer at 60° C. is lower than $10^7$ Pa, blocking occurs during storage in a roll form under standing at a high temperature which assumes the summer time or the like, or the transfer of a dye onto the backside layer, which faces a dye layer, in a roll state occurs and, at the time of rewinding, the dyes transferred onto the heat resistant slip layer are retransferred onto dye layers of other colors or the like (a kick back phenomenon), often resulting in soiling of thermally transferred images. When the loss modulus at 60° C. is above the upper limit of the above-defined range, the maximum transfer density in printing is likely to lower.

When the loss modulus of the binder resin in the dye layer at 100° C. is less than $10^6$ Pa, the release of dye occurs even in the case where the level of the energy applied is relatively low. As a result, the transfer density is higher than the set value also in the highlight part in printing, resulting in a deterioration in reproduction of thermally transferred images. When the loss modulus at 100° C. is above the upper limit of the above-defined range, the sensitivity in thermal transfer is lowered. When the loss modulus of the binder resin in the dye layer at 150° C. is less than $10^4$ Pa, abnormal transfer is likely to occur in the thermal transfer. On the other hand, when the loss modulus of the binder resin in the dye layer at 150° C. is above the above-defined range, the maximum transfer density in printing is lowered. Preferably, the binder resin in the dye layer has a glass transition temperature of 60° C. or above, and the upper limit of the glass transition temperature is about 100° C.

The binder resin for the dye layer may be any resin so far as the above specified loss modulus is satisfied. Examples of preferred binder resins include: cellulosic resins such as ethylcellulose resins, hydroxyethylcellulose resins, ethylhydroxycellulose resins, hydroxypropylcellulose resins, methylcellulose resins, cellulose acetate resins, and cellulose butyrate resins; vinyl resins such as polyvinyl alcohol resins, polyvinyl acetate resins, polyvinyl acetoacetal resins, polyvinyl butyral resins or other polyvinylacetal resins, polyvinylpyrrolidone resins, and polyacrylamide resins; polyester resins; and phenoxy resins. Among them, resins of grades (for example, molecular weight and structure) satisfying the numerical requirements of the loss modulus are selected. Cellulosic resins, acetal resins, polyester resins, phenoxy resins and the like are particularly preferred, for example, from the viewpoints of heat resistance and transferability of dye.

More preferred binder resins for the dye layer include carboxylic acid-modified polyvinyl acetal resins. In this case, the carboxylic acid-modified polyvinyl acetal resin refers to a resin in which at least a part of polyvinyl acetal has been modified with carboxylic acid. The proportion of the modification with carboxylic acid in the carboxylic acid-modified polyvinyl acetal resin may be properly selected depending upon coloring material and the like. In general, however, the proportion of the modification with carboxylic acid in the carboxylic acid-modified polyvinyl acetal resin is preferably in the range of 1 to 20% by mole in terms of vinyl alcohol unit in the carboxylic acid-modified polyvinyl acetal resin. When the proportion of the modification with carboxylic acid is below the lower limit of the above-defined range, the effect attained by the modification is poor. On the other hand, when the proportion of the modification with carboxylic acid is above the above-defined range, the water absorption of the carboxylic acid-modified polyvinyl acetal resin is increased and, consequently, the properties of the dye layer is likely to deteriorate.

The amount of the residual hydroxyl group in the carboxylic acid-modified polyvinyl acetal resin is preferably not more than 40% by mole in terms of vinyl alcohol unit in the carboxylic acid-modified polyvinyl acetal resin. When the amount of the residual hydroxyl group is above the upper limit of the above-defined range, the solubility of the resin in the solvent is lowered. Further, in this case, the water absorption is excessively increased, and, in some cases, the properties of the dye layer are deteriorated. The molecular weight of the carboxylic acid-modified polyvinyl acetal resin may be properly selected depending, for example, upon the coloring material used and is preferably in the range of 60000 to 120000.

The carboxylic acid-modified polyvinyl acetal resin may be produced by the following conventional method.

(1) A method in which a carboxylic acid-modified polyvinyl alcohol is acetalized.

(2) A method in which polyvinyl alcohol together with an aldehyde commonly used in the acetalization and a carboxyl group-containing aldehyde is acetalized.

(3) A method in which a polyvinyl acetal resin is reacted with a carboxylic anhydride such as phthalic anhydride to prepare a carboxylic acid-modified polyvinyl acetal.

Among the above methods, method (3) is particularly preferred, because the reaction procedure is easy and various carboxylic acid-modified polyvinyl acetal resins having higher purity can be produced. In methods (1) and (2), since a base is used in the neutralization of an acid catalyst in the acetaliation after the carboxylic acid modificatiion, the carboxylic acid moiety in the carboxylic acid-modified polyvinyl acetal resin is in a salt form. Accordingly, the step of converting the carboxylic acid salt to a carboxylic acid should be additionally provided. When this is taken into consideration, method (3) is most rational and preferred. The production process of a carboxylic acid-modified polyvinyl acetal resin by this preferred method will be described.

The acetalization of polyvinyl alcohol is carried out by reacting polyvinyl alcohol with an aldehyde in the presence of an acid catalyst in water or an organic solvent. Specific examples of aldehydes include formaldehyde, acetaldehyde, propionaldehyde, butyraldehyde, capronaldehyde, caprylaldehyde, capric aldehyde, benzaldehyde, 1-naphthaldehyde, phenyl acetaldehyde, o-tolualdehyde, p-tolualdehyde, o-anthaldehyde, m-anthaldehyde, p-anthaldehyde, p-ethylbenzaldehyde, o-chlorobenzaldehyde, p-chlorobenzaldehyde, and cinnamic aldehyde. If necessary, these aldehydes may be used in a combination of two or more. Among them, butyraldehyde, acetaldehyde, and phenylacetaldehyde are preferred, because the use of a resin produced by modifying a polyvinyl acetal resin, produced by acetalization with these aldehydes, with a carboxylic acid can offer a better effect. Acid catalysts usable in the acetalization include inorganic acids such as hydrochloric acid, sulfuric acid, and phosphoric acid, acetic acid and p-toluenesulfonic acid. Among them, hydrochloric acid, sulfuric acid, and p-toluenesulfonic acid are preferred. The amount of the catalyst used in the reaction is preferably 0.005 to 0.2 mole based on one mole of the aldehyde. The acetalization temperature is generally 20° C. or above, preferably 40° C. or above, and 100° C. or below, preferably 90° C. or below. The reaction time is generally 2 to 10 hr.

The polyvinyl acetal thus obtained is reacted with a carboxylic acid, preferably a di- or higher carboxylic acid anhydride. Di- or higher carboxylic anhydrides include phthalic anhydride, naphthalene-1,2-dicarboxylic anhydride, succinic anhydride, maleic anhydride, itaconic anhydride, glutaric anhydride, trimellitic anhydride, cyclohexane-1,2-dicarboxylic anhydride, and norbornane-2,3-dicarboxylic anhydride. Among them, succinic anhydride and phthalic anhydride are particularly preferred. If necessary, these acid anhyrides may be used in a combination of two or more.

This reaction may be carried out in the absence of a catalyst. The reaction can be carried out under milder conditions by using a catalyst. Catalysts usable herein include tertiary amines such as pyridine, lutidine, 4-dimethylaminopyridine, triethylamine, diisopropylethylamine, N-ethylpiperidine, and diazobicycloundecene, bases such as sodium acetate, and acids such as sulfuric acid, hydrochloric acid, zinc chloride, and perchloric acid. Among them, tertiary amines are preferred. The amount of the catalyst used is generally 0.001 to 1 mole based on one mole of the acid anhydride. This reaction is generally carried out in a solvent, and solvents usable in this reaction include various solvents such as hydrocarbon solvents, ketone solvents, ester solvents, ether solvents, and amide solvents. Specific examples thereof include N,N-dimethylformamide, methyl ethyl ketone, methyl isobutyl ketone, and toluene. The amount of the solvent used is not less than 100 parts by weight, preferably not less than 200 parts by weight, and not more than 2000 parts by weight, preferably not more than 1000 parts by weight, based on 100 parts by weight of the polyvinyl acetal resin as the starting material. The reaction temperature is generally 30° C. or above, preferably 50° C. or above, and 200° C. or below, preferably 150° C. or below. The reaction time is generally about 1 to 15 hr.

In a preferred embodiment of the present invention, the above carboxylic acid-modified polyvinyl acetal resins may be used. In this case, the carboxylic acid-modified polyvinyl acetal resins may be used either solely or in a combination of two or more types of them. Specifically, a carboxylic acid-modified polyvinyl acetal resin produced by using any combination of starting materials such as the above polyvinyl acetal resin and carboxylic acid may also be used. Among others, polyvinyl acetal resins modified with di- or higher carboxylic acid anhydrides are preferred. Specific preferred modified resins include succinic anhydride modification products of polyvinyl formal, polyvinyl acetoacetal, polyvinylbutyral, or polyvinyl phenylacetoacetal.

The dye layer comprises the above dye, binder resin and optionally various additives commonly used in the art. A mixture of a carboxylic acid-modified polyvinyl acetal resin with a resin described may also be used as the binder resin. Additives usable herein include, for example, organic fine particles such as polyethylene wax and inorganic fine particles for improving the releasability from an image receiving sheet or the coatability of ink. The dye layer may be generally formed by dissolving or dispersing the above dye and binder and optionally additives in a suitable solvent to prepare the coating liquid, then coating the coating liquid onto a base material and drying the coating. The coating liquid may be coated by conventional means such as gravure printing, screen printing, or reverse roll coating using a gravure plate. The coverage of the dye layer is 0.2 to 6.0 g/m$^2$, preferably about 0.3 to 3.0 g/m$^2$, on a dry basis.

(Heat Resistant Slip Layer)

In the thermal transfer sheet according to the present invention, a heat resistant slip layer (referred to also as "backside layer") 3 is provided on one side of a base material to prevent adverse effects such as heat sticking of the base material to a thermal head and cockling in the printing. Any conventional resin may be used as the resin for forming the heat resistant slip layer, and examples thereof include polyvinyl butyral resins, polyvinyl acetoacetal resins, polyester resins, vinyl chloride-vinyl acetate copolymers, polyether resins, polybutadiene resins, styrene-butadiene copolymers, acrylic polyols, polyurethane acrylates, polyester acrylates, polyether acrylates, epoxy acrylates, prepolymers of urethane or epoxy, nitrocellulose resins, cellulose nitrate resins, cellulose acetopropionate resins, cellulose acetate butyrate resins, cellulose acetate hydrodiene phthalate resins, cellulose acetate resins, aromatic polyamide resins, polyimide resins, polyamide-imide resins, polycarbonate resins, and chlorinated polyolefin resins.

Slipperiness-imparting agents added to or topcoated on the heat resistant slip layer formed of the above resin include phosphoric esters, silicone oils, graphite powder, silicone graft polymers, fluoro graft polymers, acrylsilicone graft polymers, acrylsiloxanes, arylsiloxanes, and other silicone polymers. Preferred is a layer formed of a polyol, for example, a high-molecular polyalcohol compound, a polyisocyanate compound and a phosphoric ester compound. Further, the addition of a filler is more preferred.

The heat resistant slip layer may be formed by dissolving or dispersing the above resin, slipperiness-imparting agent, and a filler in a suitable solvent to prepare a coating liquid for a heat resistant slip layer, coating the coating liquid onto a base material sheet by forming means such as gravure printing, screen printing, or reverse roll coating using a gravure plate, and drying the coating. The coverage of the heat resistant slip layer is preferably 0.1 to 3.0 g/m$^2$ on a solid basis.

EXAMPLE 1

The following Examples and Comparative Examples further illustrate the present invention. In the following description, "parts" or "%" is by mass unless otherwise specified. A coating liquid 1 for a dye layer having the following composition was gravure coated onto an easy adhesion-treated surface of a 3.5 μm-thick easy adhesion-treated biaxially stretched polyethylene terephthalate film (PET) at a coverage on a dry basis of 0.8 g/m$^2$, and the coating was dried to form a dye layer. Thus, a thermal transfer sheet of Example 1 was prepared. In this case, a heat resistant slip layer was previously formed on the other side of the base material by gravure coating a coating liquid for a heat resistant slip layer having the following composition at a coverage on a dry basis of 1.0 g/m$^2$ and then drying the coating.

Production process of polyvinylbutyral resin A. A polyvinylbutyral resin (tradename S-lec B BL-S, manufactured by Sekisui Chemical Co., Ltd.) (80 g), 7.1 g of succinic anhydride, and 200 g of N,N-dimethylformamide were weighed into a 1000-ml glass flask, and the contents were slowly stirred. The flask was placed on an oil bath, and the temperature was raised to 60° C. over a period of 30 min to completely dissolve the contents and was then raised to 100° C. over a period of 30 min. The contents of the flask were held at 100° C. for 6 hr and were then allowed to cool. The whole quantity of the contents were gradually added dropwise to a beaker containing 1600 g of water. The resultant particulate precipitate was collected by filtration, was washed with 160 g of water, and was transferred to a 3-L flask. Water (1600 g) and 160 g of methanol were placed in the flask, and the mixture was stirred at 45° C. for one hr. The resultant precipitate was collected by filtration, was washed with 160 g of water, was transferred to a stainless steel vat, and was dried in a hot-air dryer at 60° C. for 42 hr. The dried product was transferred to a vacuum dryer where drying was carried out under conditions of degree of vacuum 5 Torr, temperature 70° C., and drying time 119 hr to give 83 g of a modified polyvinyl acetal resin. This resin had an acid value of 40 mg KOH/g and a molecular weight of about 120000. Thus, a polymer represented by the following formula, wherein R'=$C_3H_7$, R"=—$CH_2CH_2$—, a=0, b=60, c=29, d=3 and e=8, was prepared.

-continued

| | |
|---|---|
| Polyisocyanate curing agent (Takenate D218, manufactured by Takeda Chemical Industries, Ltd.) | 0.6 part |
| Phosphoric ester (Plysurf A 208S, manufactured by Dai-Ichi Kogyo Seiyaku Co., Ltd.) | 0.8 part |
| Methyl ethyl ketone | 42.5 parts |
| Toluene | 42.5 parts |

EXAMPLE 2

The same base material of PET film as in Example 1 was provided. The same heat resistant slip layer as in Example 1 was previously formed on the surface of the base material remote from the easy adhesion treated surface. A coating liquid 2 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Example 2 was prepared. A polyvinyl butyral resin B was synthesized in the same manner as described. (Reaction time: 5 hr, molecular weight: about 100000).

<Composition of Coating Liquid 2 for Dye Layer>

| | |
|---|---|
| Solvent Blue 63 | 3.0 parts |
| Disperse Blue 354 | 2.0 parts |
| Polyvinyl butyral resin B (loss modulus at 60° C. of 3.3 × 10$^7$ Pa, loss modulus at 100° C. of 3.1 × 10$^7$ Pa, and loss modulus at 150° C. of 8.4 × 10$^4$ Pa) | 4.0 parts |
| Methyl ethyl ketone | 45.5 parts |
| Toluene | 45.5 parts |

[Chemical Formula 1]

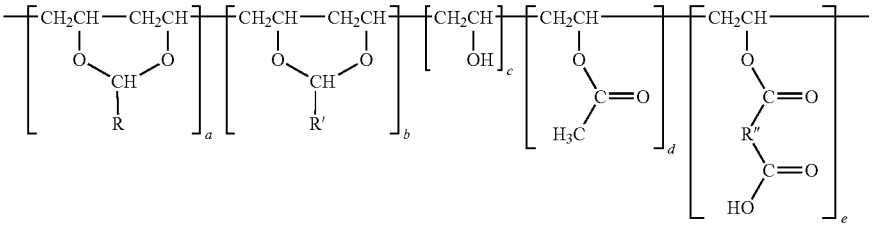

<Composition of Coating Liquid 1 for Dye Layer>

| | |
|---|---|
| Solvent Blue 63 | 3.0 parts |
| Disperse Blue 354 | 2.0 parts |
| Polyvinyl butyral resin A (loss modulus at 60° C. of 1.7 × 10$^7$ Pa, loss modulus at 100° C. of 1.5 × 10$^7$ Pa, and loss modulus at 150° C. of 3.9 × 10$^4$ Pa) | 4.0 parts |
| Methyl ethyl ketone | 45.5 parts |
| Toluene | 45.5 parts |

<Composition of Coating Liquid for Heat Resistant Slip Layer>

| | |
|---|---|
| Polyvinyl butyral resin (S-lec BX-1, manufactured by Sekisui Chemical Co., Ltd.) | 13.6 parts |

-continued

| | |
|---|---|
| Methyl ethyl ketone | 45.5 parts |
| Toluene | 45.5 parts |

EXAMPLE 3

The same base material of PET film as in Example 1 was provided. The same heat resistant slip layer as in Example 1 was previously formed on the surface of the base material remote from the easy adhesion treated surface. A coating liquid 3 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Example 3 was prepared.

<Composition of Coating Liquid 3 for Dye Layer>

| | |
|---|---|
| Solvent Blue 63 | 3.0 parts |
| Disperse Blue 354 | 2.0 parts |
| Polyvinyl butyral resin B | 2.0 parts |
| Polyvinyl acetal resin (S-lec KS-5, manufactured by Sekisui Chemical Co., Ltd.) (For the mixed resin, loss modulus at 60° C. of $3.6 \times 10^7$ Pa, loss modulus at 100° C. of $1.5 \times 10^7$ Pa, and loss modulus at 150° C. of $3.2 \times 10^4$ Pa) | 2.0 parts |
| Methyl ethyl ketone | 45.5 parts |
| Toluene | 45.5 parts |

EXAMPLE 4

The same base material of PET film as in Example 1 was provided. The same heat resistant slip layer as in Example 1 was previously formed on the surface of the base material remote from the easy adhesion treated surface. A coating liquid 4 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Example 4 was prepared.

<Composition of Coating Liquid 4 for Dye Layer>

| | |
|---|---|
| Disperse Yellow 201 | 2.0 parts |
| Disperse Yellow 231 | 2.0 parts |
| Polyvinyl butyral resin B (loss modulus at 60° C. of $3.3 \times 10^7$ Pa, loss modulus at 100° C. of $3.1 \times 10^7$ Pa, and loss modulus at 150° C. of $8.4 \times 10^4$ Pa) | 4.0 parts |
| Methyl ethyl ketone | 45.5 parts |
| Toluene | 45.5 parts |

COMPARATIVE EXAMPLE 1

The same base material of PET film as in Example 1 was provided. The same heat resistant slip layer as in Example 1 was previously formed on the surface of the base material remote from the easy adhesion treated surface. A coating liquid 5 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Comparative Example 1 was prepared. A polyvinyl butyral resin C was synthesized in the same manner as described. (Reaction time: 4 hr, molecular weight: about 80000).

<Composition of Coating Liquid 5 for Dye Layer>

| | |
|---|---|
| Solvent Blue 63 | 3.0 parts |
| Disperse Blue 354 | 2.0 parts |
| Polyvinyl butyral resin C (loss modulus at 60° C. of $3.5 \times 10^6$ Pa, loss modulus at 100° C. of $1.6 \times 10^6$ Pa, and loss modulus at 150° C. of $3.0 \times 10^4$ Pa) | 4.0 parts |
| Methyl ethyl ketone | 45.5 parts |
| Toluene | 45.5 parts |

COMPARATIVE EXAMPLE 2

The same base material of PET film as in Example 1 was provided. The same heat resistant slip layer as in Example 1 was previously formed on the surface of the base material remote from the easy adhesion treated surface. A coating liquid 6 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Comparative Example 2 was prepared.

<Composition of Coating Liquid 6 for Dye Layer>

| | |
|---|---|
| Solvent Blue 63 | 3.0 parts |
| Disperse Blue 354 | 2.0 parts |
| Acrylic polyol resin (Acryt 6AN-213 (50 wt % solution) manufactured by Taiseikako Co., Ltd.) | 2.0 parts |
| Polyvinyl acetal resin (S-lec KS-5, manufactured by Sekisui Chemical Co., Ltd.) (For the mixed resin, loss modulus at 60° C. of $2.4 \times 10^6$ Pa, loss modulus at 100° C. of $2.0 \times 10^6$ Pa, and loss modulus at 150° C. of $4.5 \times 10^4$ Pa) | 2.0 parts |
| Methyl ethyl ketone | 45.5 parts |
| Toluene | 45.5 parts |

COMPARATIVE EXAMPLE 3

The same base material of PET film as in Example 1 was provided. The same heat resistant slip layer as in Example 1 was previously formed on the surface of the base material remote from the easy adhesion treated surface. A coating liquid 7 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Comparative Example 3 was prepared.

<Composition of Coating Liquid 7 for Dye Layer>

| | |
|---|---|
| Solvent Blue 63 | 3.0 parts |
| Disperse Blue 354 | 2.0 parts |
| Polyvinyl butyral resin (S-lec BL-2, manufactured by Sekisui Chemical Co., Ltd.) (loss modulus at 60° C. of $6.6 \times 10^6$ Pa, loss modulus at 100° C. of $1.5 \times 10^5$ Pa, and loss modulus at 150° C. of $2.2 \times 10^4$ Pa) | 4.0 parts |
| Methyl ethyl ketone | 45.5 parts |
| Toluene | 45.5 parts |

COMPARATIVE EXAMPLE 4

The same base material of PET film as in Example 1 was provided. The same heat resistant slip layer as in Example 1 was previously formed on the surface of the base material remote from the easy adhesion treated surface. A coating liquid 8 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Comparative Example 4 was prepared.

<Composition of Coating Liquid 8 for Dye Layer>

| | |
|---|---|
| Solvent Blue 63 | 3.0 parts |
| Disperse Blue 354 | 2.0 parts |
| Acrylic polyol resin (Acryt 6AN-213 (50 wt % solution) manufactured by Taiseikako Co., Ltd.) (loss modulus at 60° C. of $1.0 \times 10^6$ Pa, loss modulus at 100° C. of $3.2 \times 10^4$ Pa, and loss modulus at 150° C. of $3.1 \times 10^2$ Pa) | 4.0 parts |
| Methyl ethyl ketone | 45.5 parts |
| Toluene | 45.5 parts |

COMPARATIVE EXAMPLE 5

The same base material of PET film as in Example 1 was provided. The same heat resistant slip layer as in Example 1 was previously formed on the surface of the base material remote from the easy adhesion treated surface. A coating liquid 9 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Comparative Example 5 was prepared.

<Composition of Coating Liquid 9 for Dye Layer>

| | |
|---|---|
| Solvent Blue 63 | 3.0 parts |
| Disperse Blue 354 | 2.0 parts |
| Polyvinyl acetal resin (S-lec KS-5, manufactured by Sekisui Chemical Co., Ltd.) (loss modulus at 60° C. of $3.3 \times 10^7$ Pa, loss modulus at 100° C. of $3.1 \times 10^7$ Pa, and loss modulus at 150° C. of $1.2 \times 10^5$ Pa) | 4.0 parts |
| Methyl ethyl ketone | 45.5 parts |
| Toluene | 45.5 parts |

COMPARATIVE EXAMPLE 6

The same base material of PET film as in Example 1 was provided. The same heat resistant slip layer as in Example 1 was previously formed on the surface of the base material remote from the easy adhesion treated surface. A coating liquid 10 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Comparative Example 6 was prepared.

<Composition of Coating Liquid 10 for Dye Layer>

| | |
|---|---|
| Disperse Yellow 201 | 2.0 parts |
| Disperse Yellow 231 | 2.0 parts |
| Polyvinyl acetal resin (S-lec KS-5, manufactured by Sekisui Chemical Co., Ltd.) (loss modulus at 60° C. of $3.3 \times 10^7$ Pa, loss modulus at 100° C. of $3.1 \times 10^7$ Pa, and loss modulus at 150° C. of $1.2 \times 10^5$ Pa) | 4.0 parts<br>4.0 parts |
| Methyl ethyl ketone | 46.0 parts |
| Toluene | 46.0 parts |

COMPARATIVE EXAMPLE 7

The same base material of PET film as in Example 1 was provided. The same heat resistant slip layer as in Example 1 was previously formed on the surface of the base material remote from the easy adhesion treated surface. A coating liquid 11 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Comparative Example 7 was prepared.

<Composition of Coating Liquid 11 for Dye Layer>

| | |
|---|---|
| Solvent Blue 63 | 3.0 parts |
| Disperse Blue 354 | 2.0 parts |
| Acrylic resin (Dianal BR-85, manufactured by Mitsubishi Rayon Co., Ltd.) (loss modulus at 60° C. of $2.8 \times 10^7$ Pa, loss modulus at 100° C. of $1.5 \times 10^7$ Pa, and loss modulus at 150° C. of $1.9 \times 10^5$ Pa) | 4.0 parts |
| Methyl ethyl ketone | 45.5 parts |
| Toluene | 45.5 parts |

COMPARATIVE EXAMPLE 8

The same base material of PET film as in Example 1 was provided. The same heat resistant slip layer as in Example 1 was previously formed on the surface of the base material remote from the easy adhesion treated surface. A coating liquid 12 for a dye layer having the following composition was gravure coated onto the surface of the base material remote from the heat resistant slip layer at a coverage on a dry basis of 0.8 g/m$^2$, and the coating was dried to form a dye layer. Thus, a thermal transfer sheet of Comparative Example 8 was prepared.

<Composition of Coating Liquid 12 for Dye Layer>

| | |
|---|---|
| Solvent Blue 63 | 3.0 parts |
| Disperse Blue 354 | 2.0 parts |
| Acrylic resin (Dianal BR-80, manufactured by Mitsubishi Rayon Co., Ltd.) (loss modulus at 60° C. of $9.4 \times 10^7$ Pa, loss modulus at 100° C. of $7.8 \times 10^7$ Pa, and loss modulus at 150° C. of $4.1 \times 10^5$ Pa) | 4.0 parts |
| Methyl ethyl ketone | 45.5 parts |
| Toluene | 45.5 parts |

The thermal transfer sheets of Examples and Comparative Examples prepared above were evaluated for heat-resistant adhesion and adhesion to an image receiving sheet under room temperature and high temperature/high humidity conditions.

The thermal transfer sheets of Examples and Comparative Examples prepared above were evaluated for the maximum print density, reproduction of highlight part, abnormal transfer, blocking resistance, and offset of dye onto the heat resistant slip layer by the following methods.

(Maximum Print Density)

Printing was carried out under the following conditions, and the maximum density of the printed matter was measured. The thermal transfer sheets prepared in Examples 1 to 4 and Comparative Examples 1 to 8 were used in combination with specialty standard printing paper for a compact photoprinter CP-200 manufactured by Canon Inc., and printing was carried out with a compact photoprinter CP-200 manufactured by Canon Inc. The maximum density (yellow or cyan) in the printed part was measured with a Macbeth densitometer RD-918, manufactured by Sakata INX Corp. The thermal transfer sheet was cut and pasted onto a yellow or cyan panel part (genuine media), and a yellow or cyan blotted image (gradation value 255/255: density max) print pattern was printed under an environment of temperature 30° C. and humidity 50% RH.

The maximum print density was evaluated according to the following criteria. Regarding a cyan ribbon, relative to the maximum density in Comparative Example 5 and, regarding a yellow ribbon, relative to the maximum print density in Comparative Example 6, ○: No less than 105% which is a satisfactory high density x: Less than 100% which is not a satisfactory high density (Reproduction of Highlight Part)

Printing was carried out under the following conditions, and the reproduction of gradation in the highlight part in the printed matter was examined. The thermal transfer sheets prepared in Examples 1 to 4 and Comparative Examples 1 to 8 were used in combination with specialty standard printing paper for a compact photoprinter CP-200 manufactured by Canon Inc., and printing was carried out with a compact photoprinter CP-200 manufactured by Canon Inc. The density (yellow or cyan) in the printed part was measured with a Macbeth densitometer RD-918, manufactured by Sakata INX Corp. The thermal transfer sheet was cut and pasted onto a yellow or cyan panel part (genuine media), and a yellow or cyan highlight part (gradation value 1/255 to 50/255) gradation print pattern was printed under an environment of temperature 30° C. and humidity 50% RH.

The reproduction of the highlight part was evaluated according to the following criteria. Regarding a cyan ribbon, relative to the reproduction of gradation in Comparative Example 5 and, regarding a yellow ribbon, relative to the reproduction of gradation in Comparative Example 6, ○: Equivalent level of reproduction of gradation, that is, good reproduction.

x: Unsatisfactory reproduction of gradation (higher print density than the reference)

(Abnormal Transfer)

A blotted image (gradation value 255/255: density max) print pattern was printed on the whole area of the printed matter in the same manner as in the evaluation of the above maximum print density. In this printing, whether or not heat fusing of the dye layer in the thermal transfer sheet to the object or the transfer of the dye together with the dye layer onto the object, that is, abnormal transfer, occurs, was visually inspected.

The results were evaluated according to the following criteria.

○: Neither heat fusing of dye layer to object nor abnormal transfer occurred.

x: Heat fusing of dye layer to object or abnormal transfer occurred.

(Anti-Blocking Property)

For the thermal transfer sheets of Examples and Comparative Examples prepared above, the dye layer and the heat resistant slip layer were put on top of each other, and the assembly was stored at 60° C. for 100 hr under a load of 20 g/cm$^2$. The thermal transfer sheet after the storage was visually inspected for blocking between the dye layer and the heat resistant slip layer. The results were evaluated according to the following criteria.

○: Blocking between the dye layer and the heat resistant slip layer was not observed, that is, the anti-blocking property was good.

x: Blocking between the dye layer and the heat resistant slip layer was observed, that is, the anti-blocking property was poor.

(Offset of Dye onto Heat Resistant Slip Layer)

For the thermal transfer sheets of Examples and Comparative Examples prepared above, the dye layer and the heat resistant slip layer were put on top of each other, and the assembly was allowed to stand at 60° C. for 24 hr under a load of 20 g/cm$^2$. Thereafter, the temperature was returned to room temperature, and the dye layer was separated from the heat resistant slip layer. In this case, the level of the transfer of the dye onto the heat resistant slip layer side was visually observed. The results were evaluated according to the following criteria.

○: Dye transfer was not observed, that is, the anti-offset property was good.

x: Dye transfer was observed, that is, the anti-offset property was poor.

The results of evaluation for Examples and Comparative Examples are shown in Table 1.

TABLE 1

| | Max. print density | Reproducibility of highlight part | Abnormal transfer | Anti-blocking properties | Offset of dye onto heat-resistant slip layer |
|---|---|---|---|---|---|
| Example 1 | ○ | ○ | ○ | ○ | ○ |
| Example 2 | ○ | ○ | ○ | ○ | ○ |
| Example 3 | ○ | ○ | ○ | ○ | ○ |
| Example 4 | ○ | ○ | ○ | ○ | ○ |
| Comparative Example 1 | ○ | ○ | ○ | X | X |
| Comparative Example 2 | ○ | ○ | ○ | X | X |
| Comparative Example 3 | ○ | X | ○ | X | X |
| Comparative Example 4 | ○ | X | X | X | X |
| Comparative Example 5 | X | ○ | ○ | ○ | ○ |
| Comparative Example 6 | X | ○ | ○ | ○ | ○ |

TABLE 1-continued

| | Max. print density | Reproducibility of highlight part | Abnormal transfer | Anti-blocking properties | Offset of dye onto heat-resistant slip layer |
|---|---|---|---|---|---|
| Comparative Example 7 | X | ○ | ○ | ○ | ○ |
| Comparative Example 8 | X | ○ | ○ | ○ | ○ |

As is apparent from the above results, all the thermal transfer sheets of Examples 1 to 4 had a loss modulus at 60° C. of not less than $10^7$ Pa, a loss modulus at 100° C. of not less than $10^6$ Pa, and a loss modulus at 150° C. of not less than $10^4$ Pa and not more than $10^5$ Pa, which were on such a level that satisfied the maximum print density requirement, and had good reproduction in the highlight part, caused no abnormal transfer, caused no blocking, and caused no offset of dye onto the heat resistant slip layer.

On the other hand, the thermal transfer sheets of Comparative Examples 1 and 2 had a loss modulus at 60° C. of less than $10^7$ Pa and caused blocking under standing at a high temperature which assumes the summer time or the like, or the transfer of dye onto the heat resistant slip layer which faces the dye layer.

The thermal transfer sheet of Example 3 having a loss modulus at 60° C. of less than $10^7$ Pa and a loss modulus at 100° C. of less than $10^6$ Pa caused blocking, caused the transfer of dye onto the heat resistant slip layer which faces the dye layer, or caused a higher transfer density in the highlight part than the set value, resulting in deteriorated reproduction of thermally transferred images. The thermal transfer sheet of Comparative Example 4 having a loss modulus at 60° C. of less than $10^7$ Pa, a loss modulus at 100° C. of less than $10^6$ Pa, and a loss modulus at 150° C. of less than $10^4$ Pa caused blocking, caused the transfer of dye onto the heat resistant slip layer which faces the dye layer, caused a higher transfer density in the highlight part than the set value resulting in deteriorated reproduction of thermally transferred images, or caused abnormal transfer in the thermal transfer. The thermal transfer sheets of Comparative Examples 5 to 8 having a loss modulus at 150° C. of more than $1\times10^5$ Pa had a low maximum transfer density in the printing and thus were unsatisfactory.

Figure 3:
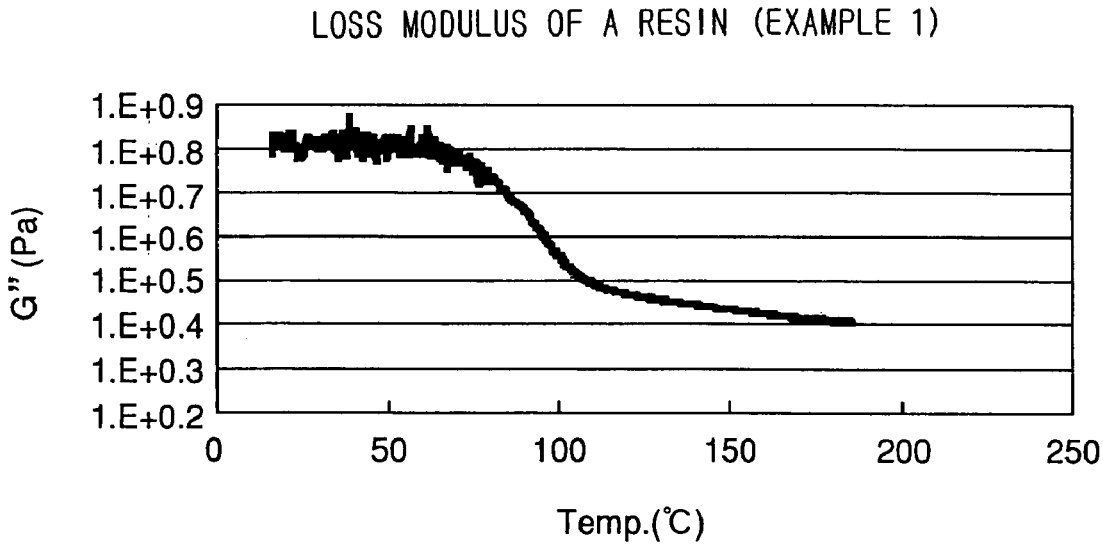
FIG. 3 is a graph showing a change in loss modulus of a binder resin used in a dye layer in the thermal transfer sheet according to the present invention as a function of temperature.

In the thermal transfer sheet prepared in Example 1, for the binder resin contained in the coating liquid for a dye layer used, the temperature of the binder resin was raised from 30° C. to 200° C. FIG. 3 is a graph showing a change in loss modulus as a function of the temperature.

The invention claimed is:

1. A thermal transfer sheet comprising a base material, a heat resistant slip layer provided on one side of the base material, and a dye layer provided on the other side of the base material, wherein said dye layer comprises a binder resin having a loss modulus at 60° C. of not less than $10^7$ Pa, a loss modulus at 100° C. of not less than $10^6$ Pa and a loss modulus at 150° C. in the range of $10^4$ Pa to $10^5$ Pa, and said binder comprises a carboxylic acid-modified polyvinyl acetal obtained by reacting a polyvinyl acetal with succinic anhydride or phthalic anhydride.

2. The thermal transfer sheet according to claim 1, wherein said binder resin has a glass transition temperature of 60° C. or above.

3. The thermal transfer sheet according to claim 1, wherein the binder resin constituting the dye layer has a loss modulus at 60° C. in the range of $10^7$ Pa to $10^8$ Pa.

4. The thermal transfer sheet according to claim 1, wherein the binder resin constituting the dye layer has a loss modulus at 100° C. in the range of $10^6$ Pa to $10^8$ Pa.

5. The thermal transfer sheet according to claim 1, wherein a primer layer is provided between the base material and the dye layer.

* * * * *